US005768340A

United States Patent [19]

Geittner et al.

[11] Patent Number: 5,768,340

[45] Date of Patent: Jun. 16, 1998

[54] X-RAY EXAMINATION APPARATUS WITH X-RAY FILTER

[75] Inventors: Peter E. E. Geittner, Aachen; Petrus W. J. Linders, Eindhoven; Hans-Jürgen Lydtin, Stolberg, all of Germany

[73] Assignee: U.S. Philips Corporation, New York, N.Y.

[21] Appl. No.: 800,250

[22] Filed: Feb. 13, 1997

[30] Foreign Application Priority Data

Feb. 14, 1996 [EP] European Pat. Off. ..... 96200360

[51] Int. Cl.[6] ..... G21K 3/00

[52] U.S. Cl. ..... 378/159; 378/156

[58] Field of Search ..... 378/156, 159

[56] References Cited

U.S. PATENT DOCUMENTS

| | | | |
|---|---|---|---|
| 3,755,672 | 8/1973 | Edholm | 378/159 |
| 5,559,853 | 9/1996 | Linders et al. | 378/159 |
| 5,625,665 | 4/1997 | Fokkink et al. | 378/156 |
| 5,666,396 | 9/1997 | Linders et al. | 378/156 |

FOREIGN PATENT DOCUMENTS

| | | |
|---|---|---|
| 2599886 | 12/1987 | France . |
| 2599886A | 12/1987 | France . |
| 8903110 | 7/1991 | Netherlands . |
| WO9600967 | 1/1996 | WIPO . |
| WO9613040 | 5/1996 | WIPO . |

*Primary Examiner*—Craig E. Church
*Attorney, Agent, or Firm*—Jack D. Slobod

[57] ABSTRACT

An X-ray examination apparatus includes an X-ray filter with a plurality of filter elements for locally attenuating the X-ray beam. The X-ray absorptivity of each filter element is controlled by the amount of X-ray absorbing liquid with which the filter element is filled. The filling of filter elements is controlled by a voltage. The X-ray absorbing liquid contains a suspension of very small X-ray absorbing particles.

20 Claims, 3 Drawing Sheets

X-RAY EXAMINATION APPARATUS WITH X-RAY FILTER

BACKGROUND OF THE INVENTION

1. Field of the Invention

The invention relates to an X-ray examination apparatus with an X-ray source, an X-ray detector, an X-ray filter between the X-ray source and the X-ray detector, the x-ray filter with a plurality of filter elements having an X-ray absorptivity which is adjustable by controlling an amount of X-ray absorbing liquid in separate filter elements.

2. Description of the Related Art

An X-ray examination apparatus of this kind is known from French Patent Application FR 2 599 886.

The known X-ray apparatus comprises a X-ray filter for limiting the dynamic range of an X-ray image, being the interval between the extremes of the brightness values. An X-ray image is formed on the X-ray detector by arranging an object, for example a patient to be examined, between the X-ray source and the X-ray detector and by irradiating said object by means of X-rays emitted by the X-ray source. If no steps are taken, the dynamic range of the X-ray image may be large. For some parts of the object, for example lung tissue, the X-ray transmittance will be high whereas other parts of the object, for example bone tissue, can hardly be penetrated by X-rays. Lead shutters which are used to intercept parts of the X-ray beam emitted by the X-ray source in order to shield parts of the object to be examined from the X-rays are imaged with a uniform, very low brightness. Lead shutters are also used to prevent X-rays which do not pass through the object from reaching the X-ray detector, thus causing overexposure in the X-ray image. If no further steps are taken, therefore, an X-ray image is obtained with a large dynamic range whereas, for example medically relevant information in the X-ray image is contained in brightness variations in a much smaller dynamic range; because it is not very well possible to make small details of low contrast suitably visible in a rendition of such an X-ray image, such an X-ray image cannot be used very well for making a diagnosis. Furthermore, problems are encountered when such an X-ray image is picked up by means of an image intensifier pick-up chain. An image intensifier pick-up chain comprises an image intensifier tube for converting an incident X-ray image into a light image and a video camera for deriving an electronic image signal from the light image. From regions of very high or very low brightness in the X-ray image, regions of very high and very low brightness, respectively, are formed in the light image. If no further steps are taken, the dynamic range of the light image could be larger than the range of brightness values that can be handled by the video camera without causing disturbances in the electronic image signal.

In order to limit the dynamic range of the X-ray image, the known X-ray examination apparatus comprises a X-ray filter with X-ray filter elements provided with a bundle of parallel capillary tubes, each of which is connected, via a valve, to a reservoir containing an X-ray absorbing liquid which suitably wets the inner walls of the capillary tubes. In order to fill a capillary tube with the X-ray absorbing liquid, the valve of the relevant capillary tube is opened, after which the capillary tube is filled with the X-ray absorbing liquid by the capillary effect. Such a filled capillary tube has a high X-ray absorptivity for X-rays passing through such a filled capillary tube in a direction approximately parallel to its longitudinal direction. The valves are controlled so as to ensure that the amount of X-ray absorbing liquid in the capillary tubes is adjusted so that filter elements in parts of the X-ray beam which pass through object parts of low absorptivity are adjusted to a high X-ray absorptivity and filter elements in parts of the X-ray beam which pass through object parts of high absorptivity, or are intercepted by a lead shutter, are adjusted to a low X-ray absorptivity.

In order to change the adjustment of the X-ray filter of the known X-ray examination apparatus it is necessary to empty filled capillary tubes first. Therefore, use is made of a paramagnetic X-ray absorbing liquid which is removed from the capillary tubes by application of a magnetic field. After all capillary tubes have been emptied, the X-ray filter is adjusted anew by deactivation of the magnetic field and subsequent opening of the valves of capillary tubes which are filled with the X-ray absorbing liquid for the new X-ray filter setting so as to adjust these tubes to a high X-ray absorptivity.

It is a drawback of the known X-ray filter that it is not very well possible to change the setting of the X-ray filter within a brief period of time, for example one second. Therefore, the known X-ray apparatus is not suitable for forming successive X-ray images at a high image rate where the setting of the X-ray filter is changed between the formation of successive X-ray images. Switching over the known X-ray filter is rather time-consuming because it is necessary to empty all capillary tubes before the filter elements can be adjusted to new X-ray absorptivities and because the X-ray absorbing liquid suitably wets the inner wall of the capillary tube so that emptying requires a substantial period of time, i.e. several seconds or even tens of seconds. Moreover, the capillary tube cannot be readily made completely empty by application of the magnetic field, because a layer of X-ray absorbing liquid will adhere to the inner walls of the capillary tubes.

It is a further drawback of the known X-ray filter that the construction utilizing separate mechanical valves for each of the capillary tubes is rather complex.

SUMMARY OF THE INVENTION

It is inter alia an object of the invention to provide an x-ray apparatus which comprises a X-ray filter whose setting can be changed within a brief period of time.

This object is achieved by an X-ray examination apparatus according to the invention which is characterized in that the X-ray absorbing liquid contains a suspension of very small particles in a solvent, which particles contain a material with a high atomic number.

The X-ray examination apparatus is provided with an adjusting circuit for supplying electric voltages to separate filter elements. The relative amount of X-ray absorbing liquid in the separate filter elements is controlled by the electric voltage applied to the relevant filter elements. The relative amount of X-ray absorbing liquid is to be understood to mean the amount of X-ray absorbing liquid in the filter element relative to the amount of X-ray absorbing liquid in such a filter element when that filter element is completely filled with X-ray absorbing liquid. For example, in the case of a first value of the voltage the adhesion of the X-ray absorbing liquid to the inner side is increased and the relevant filter element is filled with the X-ray absorbing liquid from a reservoir. In the case of a second value of the electric voltage, the adhesion is decreased and the X-ray absorbing liquid is drained from the filter element to the reservoir. Filter elements are adjusted to a high X-ray absorptivity by filling with an X-ray absorbing liquid; they are adjusted to a low X-ray absorptivity by emptying them.

Changing the electric voltages applied to the individual filter element does not require much time (at most a few tenths of a second) and the relative quantity of X-ray absorbing liquid in the filter elements will have been changed already briefly after the changing of the electric voltages, so that changing the setting of the filter requires little time (less than one or a few seconds). Furthermore, it is not necessary to empty all filter elements between two adjustments of the X-ray filter.

The suspension of very small particles comprises a plurality of very small X-ray absorbing bodies which are suspended in a solvent. Such a suspension forms an X-ray absorbing liquid as the very small particles (VSPs) are X-ray absorbing and, like any ordinary liquid, the suspension has a consistency of flowing substantially freely, but has a constant volume. Only a small relative amount of the suspension of very small particles (VSP-suspension) is required to achieve a high X-ray absorption for individual filter elements, because such a VSP-suspension has a very high specific X-ray absorptivity. The X-ray absorption occurs in the material with a high atomic number which is included in the very small particles (VSPs). Since not much X-ray absorbing liquid is required to be moved into or out of individual filter elements for adjustment of the X-ray absorption of such filter elements, a brief time of only about 1 s or even less is required to adjust the setting of the X-ray absorption of the X-ray filter. It has been found notably that a VSP-suspension has a high specific X-ray absorptivity without causing an substantial increase in the viscosity of the X-ray absorbing liquid. It appears that a suspension can be formed which has a volume fraction of VSPs of about 40%. A volume-fraction of about 10% of the VSP in the suspension does not give rise to a significant increase of the viscosity of the VSP-suspension. Preferably, a VSP-suspension having a volume fraction in the range of between 0.5% and 5% is employed. Such a preferred VSP-suspension combines a high specific X-ray absorptivity with a low viscosity, therefore, such a preferred VSP-suspension flows easily into and out of the filter elements that are adjusted.

A preferred embodiment of an X-ray examination apparatus according to the invention is characterized in that the very small particles have a diameter substantially less than 1 μm, in particular in the range of between 5 nm and 100 nm.

In order to avoid sedimentation of VSPs from the suspension the diameter of individual VSPs is substantially less than 1 μm. Particularly good results in respect of stability against sedimentation of the VSP-suspension are achieved when the diameter of the VSPs is in the range of between 5 nm and 100 nm.

A further preferred embodiment of an X-ray examination apparatus according to the invention is characterized in that the very small particles are composed of one or more elements with an atomic number higher than 72.

A good X-ray absorption is achieved when the VSPs contain a heavy element, in particular the specific X-ray absorption of an individual VSP is adequate when a material with an atomic number at least 72 (Hf) is employed for forming the VSPs.

A further preferred embodiment of an X-ray examination apparatus according to the invention is characterized in that the solvent is water.

Water is substantially insensitive to X-radiation and is also non-toxic. Moreover, it appears to be practical to employ such materials for the inner walls of the filter elements and such a voltage range that the contact angle of a suspension in water with the wall may be adjusted around the value 90°. When the contact angle is larger than 90° the X-ray absorbing liquid doesn't enter the relevant filter element, when the contact angle is reduced to less than 90° due to the supply of an electric voltage, the X-ray absorbing liquid enters that filter element.

A further preferred embodiment of an X-ray examination apparatus according to the invention is characterized in that the solvent is water with a surface active addition.

A surface active addition enhances the stability of the suspension against sedimentation and/or formation of agglomerations of VSPs. Examples of such surface active additions are polyvinyl alcohol, aminomethylacrylates etc. Hence, uniformity of the density of the suspension is improved by employing a surface active addition. Any residual sedimentation may be counteracted by stirring the VSP-suspension in the reservoir or by applying ultra-sound pulses to the VSP-suspension.

A further preferred embodiment of an X-ray examination apparatus according to the invention is characterized in that the very small particles comprise a nucleus containing an element having a high atomic number and the nucleus being coated with a layer which is chemically inert with respect to the solvent.

The coating layer is chosen such that the suspension is substantially stable. In this respect the material properties of the X-ray absorbing material of the nucleus are of no concern with respect to ensuring stability of the VSP-suspension. Moreover, as the nucleus is chemically separated from the solvent, deterioration of the VSPs by chemical reactions with the solvent liquid are avoided. Consequently, the X-ray absorbing material of the nucleus can be chosen independently of the solvent. Furthermore, X-ray absorbing materials having a very high specific X-ray absorptivity may be employed despite such materials being more or less toxic. Toxicity of the X-ray absorbing material of the nucleus is of no concern because the nucleus is isolated from the surrounding by the coating layer. Moreover, X-ray absorbing materials that are only very poorly or not at all soluble may be employed.

These and other aspects of the invention will be described by way of example with reference to the embodiments described hereinafter and with reference to the accompanying drawing.

DETAILED DESCRIPTION OF THE PREFERRED EMBODIMENTS

Figure 1:
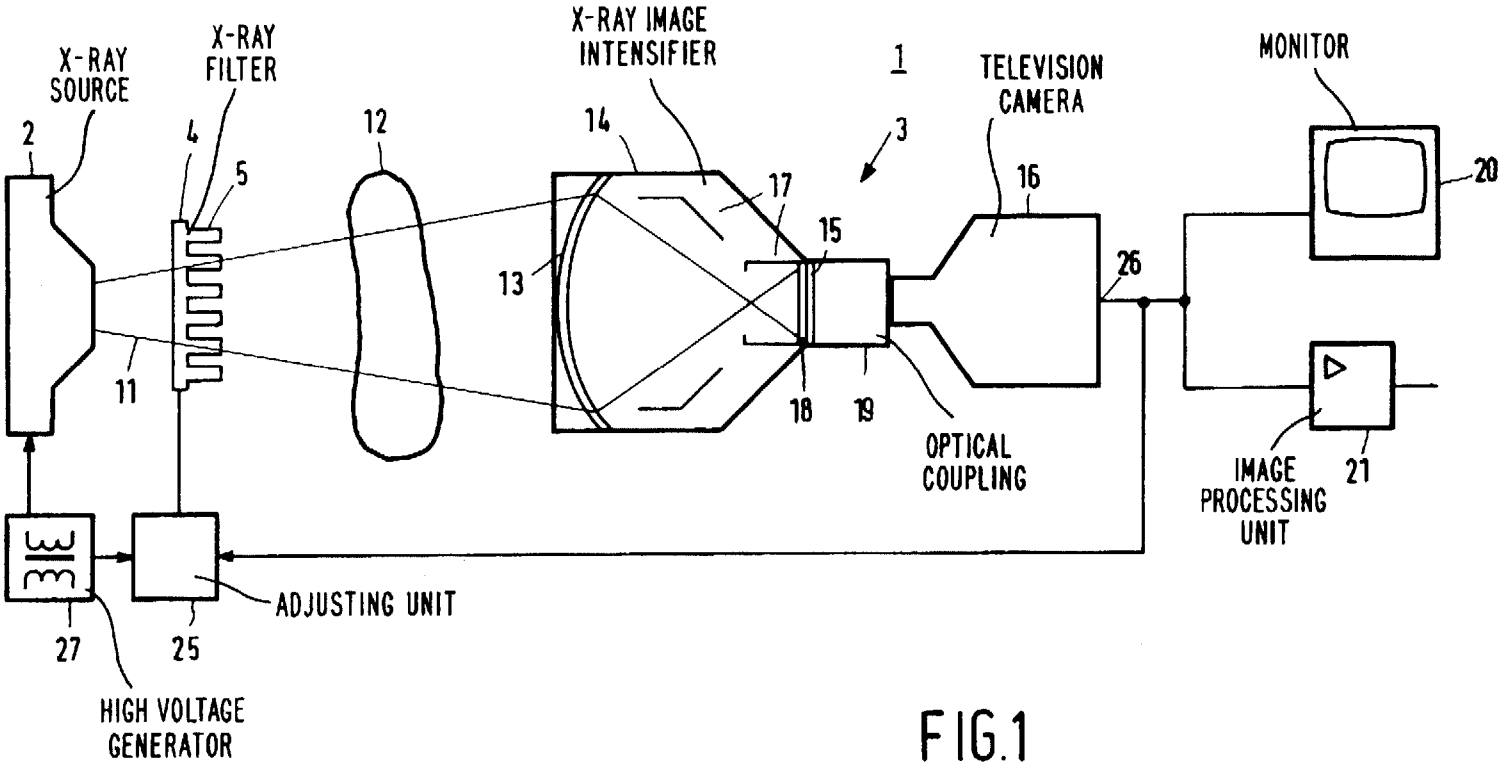
FIG.1 is a schematic representation of an X-ray examination apparatus according to the invention.

FIG. 1 is a schematic representation of an X-ray examination apparatus 1 according to the invention. The X-ray source 2 emits an X-ray beam 11 so as to irradiate an object 12, notably a patient who is to be radiologically examined. Owing to local differences in the X-ray absorption within the patient an X-ray image is formed on an X-ray sensitive face 13 of the X-ray detector 3 which faces the X-ray source. The patient 12 is positioned between the X-ray source 2 and the X-ray detector 3. In the present embodiment the X-ray detector is an image intensifier television chain which comprises an X-ray image intensifier 14 for converting the X-ray image into a light-optical image on the exit window 15 and a television camera 16 for picking-up the light-optical image. The entrance screen 13 of the X-ray image intensifier 14 functions as the X-ray sensitive face that converts incident X-rays into an electron beam that is imaged by way of an electron-optical system 17 onto a phosphor layer 18 on the exit window. The incident electrons generate the light-optical image on the phosphor layer 18. The television camera 16 is optically coupled to the X-ray image intensifier by way of an optical coupling 19 which, for example comprises a system of lenses or an optical fibre-coupling. The television camera derives an electronic image signal from the light-optical image and the electronic image is applied to a monitor 20 to display the image information in the X-ray image. The electronic image signal may also be applied to an image processing unit 21 to be processed further.

The X-ray filter 4 is positioned between the X-ray source 2 and the object 12 for local attenuation of the X-ray beam. The X-ray filter 4 comprises a plurality of filter elements 5 in the form of capillary tubes. The X-ray absorptivity of separate filter elements is controllable by means of an electrical voltage which is applied to the relevant filter element by means of an adjusting unit 25. In particular the electrical voltage is applied to the inner wall of the capillary tubes. The capillary tubes may be glass tubes that are coated on the inside with a conductive, preferably metal coating, or metal tubes may be employed. The adhesion of the X-ray absorbing liquid to the inner wall of the capillary tubes is controllable by means of the voltage. The capillary tubes communicate at one end with a reservoir for X-ray absorbing liquid. Under the control of the electrical voltages applied to separate capillary tubes, these tubes are filled with a given amount of X-ray absorbing liquid. The capillary tubes extend about parallel to the X-ray beam and, therefore, the X-ray absorptivity depends on the amount of X-ray absorbing liquid in the relevant capillary tube. The voltages are adjusted by the adjusting unit 25 under the control of brightness values of the X-ray image or of the setting of the X-ray source. To that end the adjusting unit is coupled to an output 26 of the television camera and to the high-voltage generator 27 of the X-ray source. More details of the construction of the X-ray filter are described in European Patent Application No. 94203094.1 corresponds to U.S. Pat. No. 5,625,665.

The X-ray absorbing liquid comprises a VSP-suspension which contains very small X-ray absorbing particles suspended in a solvent. The VSPs preferably have a diameter in the range of from 5 nm to 50 nm so as to achieve good stability of the suspension agaisnt sedimentation and/or formation of aggregates. Such a VSP-suspension may include a volume fraction of VSPs up to about 40%. Consequently, such VSP-suspensions show a very high specific X-ray absorptivity. Hence the capillary tubes need to be filled with the VSP-suspension only for a rather small portion in order to achieve a high X-ray absorptivity. For example when a VSP suspension with a 10% volume fraction of VSPs is used, a capillary tube needs to be filled with a column of a height of only 1 cm or less. Such a small amount of VSP solution required to fill the capillary tubes contributes significantly to reducing the time required for adjusting the X-ray filter. The X-ray filter can be readjusted within about one second. In particular the elements Hf,Ta, W,Re,Os,Ir,Pa,Hg,Tl,Pb and Bi have a relatively high specific X-ray absorptivity. The toxicity of Hg,Ti,Pb and Bi is of no concern when USPs of such elements are provided with a protective coating layer. The protective coating is preferably an anorganic coating that is not deteriorated by X-rays. For example, silicon dioxide $SiO_2$ and aluminium oxide $Al_2O_3$ are suitable materials for such a protective coating. Some elements, viz. Hf,Ta,W and Os, are not soluble in water, or there are even no chemical compounds of such elements that are soluble in water. The solubility is of no concern when a suspension of VSPs containing such elements is employed. Good results are found for the VSP-suspension of a high specific X-ray absorptivity when VSPs of W with an Au protective coating are used.

In order to improve the stability of the VSP-suspension against sedimentation and/or formation of aggregates a surface active agent is added to the solvent. Preferably, the solvent is water and as surface active agents, for example polyvinyl alcohol or aminomethylacrylates may be used. The skilled person will know that the field of colloid chemistry provides a broad class of suitable surface active agents. The relative amount of X-ray absorbing liquid is adjusted by changing the electrical voltages applied to separate filter elements. These voltages may be DC or AC in a range of up to a few hundreds of volts.

Figure 2:
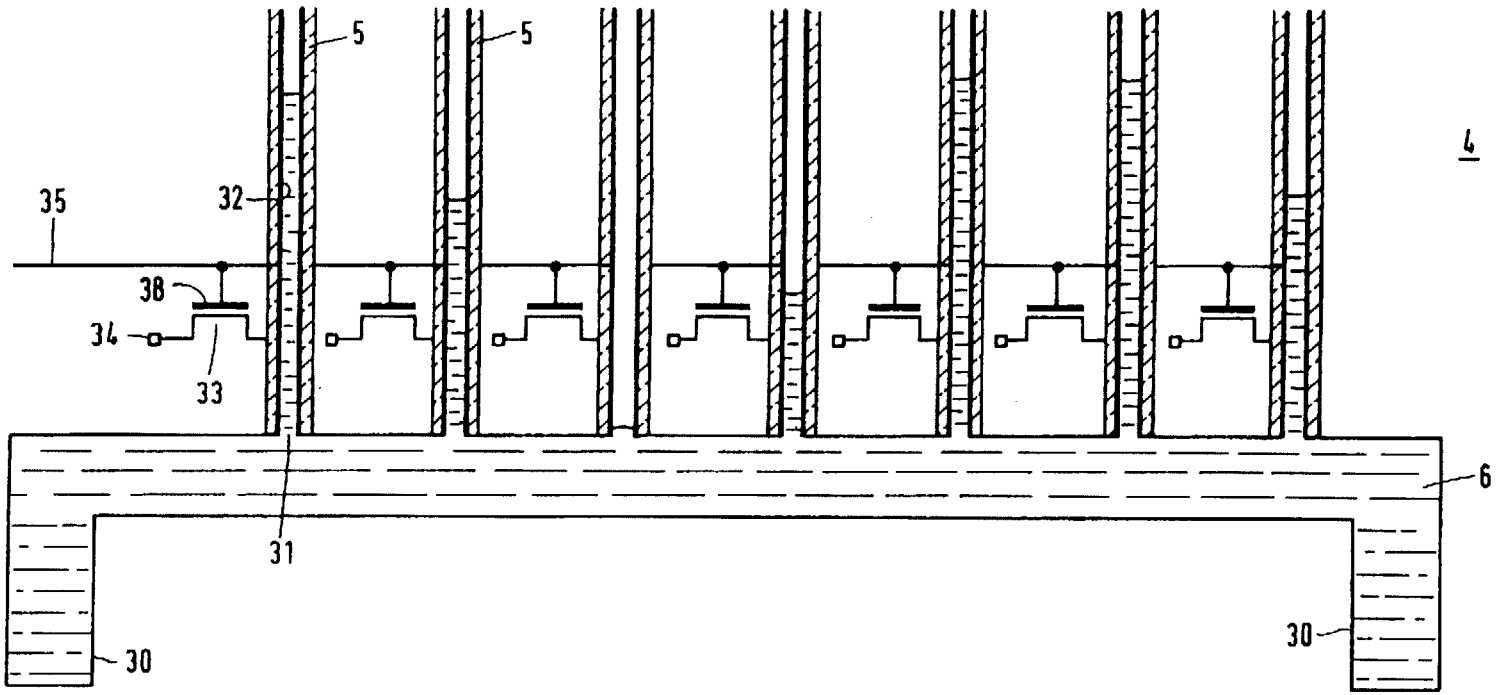
FIG. 2 is a schematic side elevation of the X-ray filter incorporated in the X-ray examination apparatus of FIG. 1.

FIG. 2 is a schematic side elevation of the X-ray filter incorporated in the X-ray examination apparatus of FIG. 1. Seven capillary tubes 5 are shown, by way of example, but in practice the X-ray filter of the invention may be provided with a vast number of capillary tubes, for example 200×200 tubes arranged in a matrix. One end 31 of the capillary tubes communicates with the X-ray absorbing liquid 6. The capillary tubes may be metal tubes or glass tubes provided with a metal coating e.g. a gold or platinum coating. In any case the capillary tubes comprise a conductive layer 32, either as the inner metal surface of the metal tube or the metal coating. The conductive layer of separate capillary tubes is coupled to a voltage line 34 by way of a switching element 33. In order to apply the electrical voltage to the conductive layer of a relevant capillary tube, the relevant switching element is closed and simultaneously the electrical voltage is applied to the voltage line that is in electrical contact with the capillary tube concerned. The switching elements are controlled by means of an addressing line 35. When voltage pulses are applied voltages in the range of from 0 V to 400 V may be applied. α-Si thin-film transistors may be employed in such a voltage range.

Preferably, on the conductive layer there is deposited a dielectric layer having a thickness sufficient to ensure that the electrical capacitance remains sufficiently low to enable a fast response of the capillary tubes to a change of the applied electrical voltage. In order to achieve that, irrespective of the material of the dielectric layer, the contact angle of the VSP-suspension with the inner wall of the capillary tubes can be varied in a range containing the critical value 90°, a cover layer may be disposed on the dielectric layer. A cover layer having suitable hydrophobic/hydrophilic properties is employed for this purpose.

Figure 3:
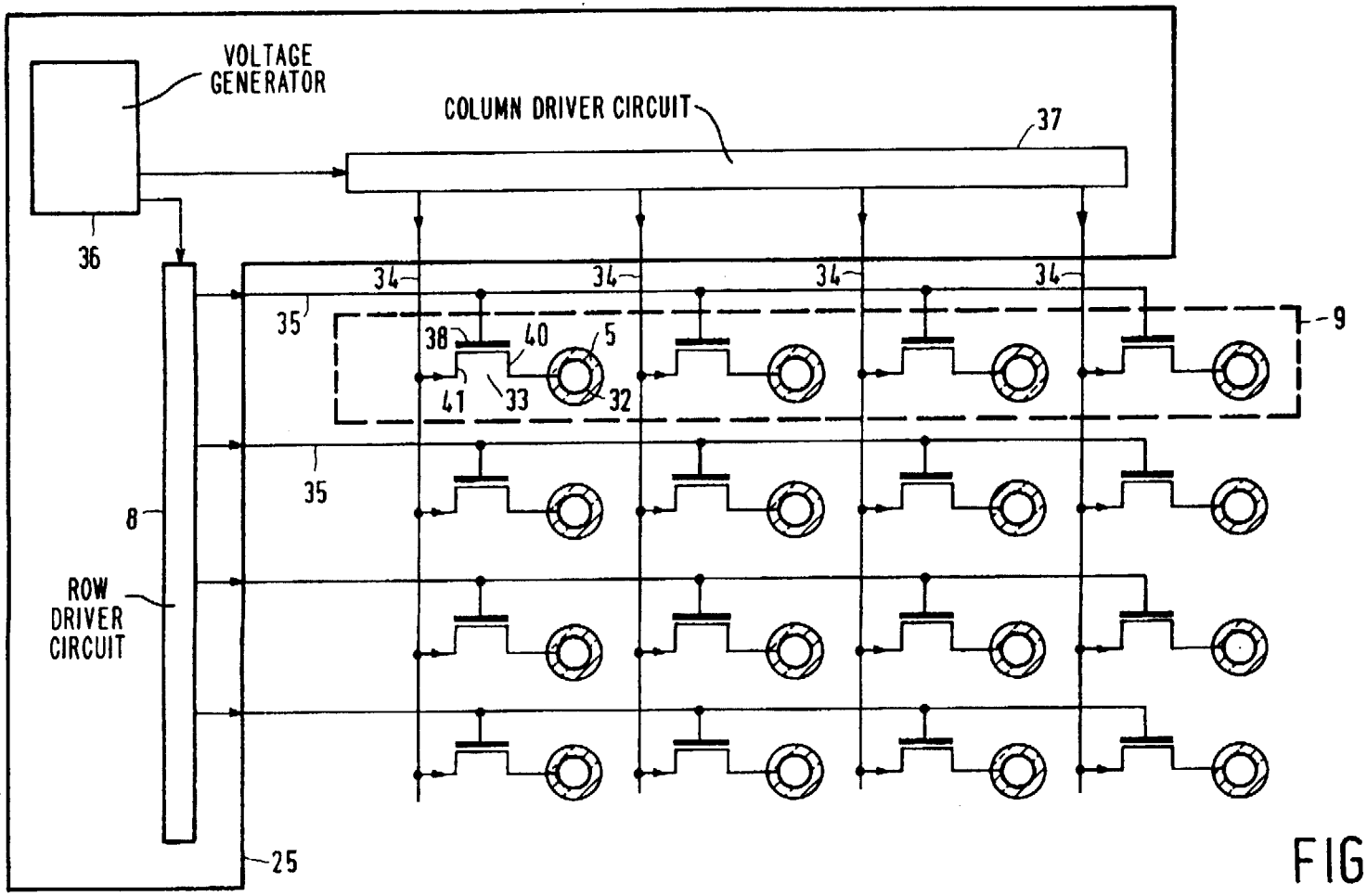
FIG. 3 is a schematic plan view of the X-ray filter incorporated in the X-ray examination apparatus of FIG. 1.

FIG. 3 is a schematic plan view of the X-ray filter incorporated in the X-ray examination apparatus of FIG. 1. By way of example and for simplicity, FIG. 3 shows an X-ray filter with a 4×4 matrix arrangement of capillary tubes, but in practice an X-ray filter having a much larger number such as 200×200 capillary tubes may be employed. Each of the capillary tubes has its conductive layer 32 coupled to the drain contact 40 of a field-effect transistor 33 which acts as a switching element and whose source contact 41 is coupled to a voltage line 34. For each row 9 of capillary tubes there is provided an addressing line 35 which is coupled to the gate contacts of the field-effect transistors in that row so as to control these field-effect transistors. In order to apply an electrical voltage to the conductive layer of the capillary tubes in a particular row, the addressing line of that row is activated in that an addressing signal is applied to that addressing line so as to turn on the field-effect transistors conductive in the row at issue. The X-ray filter comprises an adjusting unit 25 which incorporates a voltage generator 36 for applying the electrical voltage to a row driver circuit 8 that applies the addressing signals to respective addressing lines. The electrical voltages to be applied to the capillary tubes are supplied by way of a column driver circuit 37. The addressing signals select capillary tubes that are to be supplied with the electrical voltage. The voltage generator produces the addressing signals as well as the electrical voltages applied to the capillary tubes so as to control the amount of X-ray absorbing liquid in the capillary tubes. More details of controlling the electrical voltage supply to the respective capillary tubes are described in the European Patent Applications 94203094.1 (which corresponds to U.S. Pat. No. 5,625,665) and 95201925.5.

We claim:

1. An X-ray examination apparatus comprising an X-ray source, an X-ray detector, and an X-ray filter between the X-ray source and the X-ray detector, the X-ray filter comprising a plurality of filter elements in the form of respective capillary tubes having an X-ray absorptivity which is adjustable by applying electrical voltages to inner walls of the capillary tubes to control an amount of X-ray absorbing liquid in separate filter elements, wherein the X-ray absorbing liquid contains a suspension of very small particles in a solvent which particles have a diameter substantially less than 1 μm and contain a material with a high atomic number.

2. An X-ray examination apparatus as claimed in claim 1, wherein the very small particles have a diameter in the range of between 5 nm and 100 nm.

3. An X-ray examination apparatus as claimed in claim 1, wherein the very small particles are composed of one or more elements whose atomic number is at least 72.

4. An X-ray examination apparatus as claimed in any claim 1 wherein the solvent is water.

5. An X-ray examination apparatus as claimed in claim 4, wherein the solvent is water with a surface active addition.

6. An X-ray examination apparatus as claimed in claim 1, wherein the very small particles comprise a nucleus containing an element having a high atomic number, the nucleus being coated with a layer which is chemically inert with respect to the solvent.

7. An X-ray examination apparatus as claimed in claim 2, wherein the very small particles are composed of one or more elements whose atomic number is at least 72.

8. An X-ray examination apparatus as claimed in claim 2, wherein the solvent is water.

9. An X-ray examination apparatus as claimed in claim 3, wherein the solvent is water.

10. An X-ray examination apparatus as claimed in claim 4, wherein the solvent is water.

11. An X-ray examination apparatus as claimed in claim 8, wherein the solvent is water with a surface active addition.

12. An X-ray examination apparatus as claimed in claim 9, wherein the solvent is water with a surface active addition.

13. An X-ray examination apparatus as claimed in claim 10, wherein the solvent is water with a surface active addition.

14. An X-ray examination apparatus as claimed in claim 2, wherein the very small particles comprise a nucleus containing an element having a high atomic number, the nucleus being coated with a layer which is chemically inert with respect to the solvent.

15. An X-ray examination apparatus as claimed in claim 3, wherein the very small particles comprise a nucleus containing an element having a high atomic number, the nucleus being coated with a layer which is chemically inert with respect to the solvent.

16. An X-ray examination apparatus as claimed in claim 4, wherein the very small particles comprise a nucleus containing an element having a high atomic number, the nucleus being coated with a layer which is chemically inert with respect to the solvent.

17. An X-ray examination apparatus as claimed in claim 5, wherein the very small particles comprise a nucleus containing an element having a high atomic number, the nucleus being coated with a layer which is chemically inert with respect to the solvent.

18. An X-ray examination apparatus as claimed in claim 7, wherein the very small particles comprise a nucleus containing an element having a high atomic number, the nucleus being coated with a layer which is chemically inert with respect to the solvent.

19. An X-ray examination apparatus as claimed in claim 8, wherein the very small particles comprise a nucleus containing an element having a high atomic number, the nucleus being coated with a layer which is chemically inert with respect to the solvent.

20. An X-ray examination apparatus as claimed in claim 9, wherein the very small particles comprise a nucleus containing an element having a high atomic number, the nucleus being coated with a layer which is chemically inert with respect to the solvent.

* * * * *